US012077272B2

(12) United States Patent
Ikegaya

(10) Patent No.: US 12,077,272 B2
(45) Date of Patent: Sep. 3, 2024

(54) SYSTEM FOR AND METHOD OF CONTROLLING WATERCRAFT INCLUDING MARINE PROPULSION DEVICE

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 356 days.

(21) Appl. No.: 17/518,673

(22) Filed: Nov. 4, 2021

(65) Prior Publication Data

US 2022/0169352 A1 Jun. 2, 2022

(30) Foreign Application Priority Data

Nov. 27, 2020 (JP) ..... 2020-197453

(51) Int. Cl.
*B63H 20/12* (2006.01)
*B63H 25/38* (2006.01)

(52) U.S. Cl.
CPC ..... *B63H 20/12* (2013.01); *B63H 25/38* (2013.01)

(58) Field of Classification Search
CPC ..... B63H 20/12; B63H 25/38
See application file for complete search history.

(56) References Cited

FOREIGN PATENT DOCUMENTS

JP 02-227396 A 9/1990

*Primary Examiner* — Michael D Lang
(74) *Attorney, Agent, or Firm* — Keating & Bennett, LLP

(57) ABSTRACT

A joystick outputs an operating signal indicating a tilt amount and a twist direction of the joystick. A controller receives the operating signal and controls a marine propulsion device to output a thrust having a magnitude depending on the tilt amount. The controller changes a rudder angle of the marine propulsion device such that a watercraft turns in a direction corresponding to the twist direction. The controller reduces a speed of changing the rudder angle with an increase in the magnitude of the thrust.

13 Claims, 10 Drawing Sheets

SYSTEM FOR AND METHOD OF CONTROLLING WATERCRAFT INCLUDING MARINE PROPULSION DEVICE

CROSS REFERENCE TO RELATED APPLICATIONS

This application claims the benefit of priority to Japanese Patent Application No. 2020-197453 filed on Nov. 27, 2020. The entire contents of this application are hereby incorporated herein by reference.

BACKGROUND OF THE INVENTION

1. Field of the Invention

The present invention relates to a system for and a method of controlling a watercraft including a marine propulsion device.

2. Description of the Related Art

There has been conventionally known a type of system for operating a watercraft by a joystick. For example, a system described in Japan Laid-open Patent Application Publication No. H02-227396 includes a marine propulsion device and a joystick. The marine propulsion device is rotatable about a steering shaft. When rotated about the steering shaft, the marine propulsion device is changed in rudder angle. The joystick is operable by tilting and twisting. A controller in the system controls the marine propulsion device to generate a thrust in accordance with a tilt operation of the joystick. The controller changes the rudder angle of the marine propulsion device such that the watercraft turns in accordance with a twist direction of the joystick.

Even when the rudder angle of the marine propulsion device is changed at a constant velocity, the watercraft turns at a variable speed depending on the magnitude of the thrust of the watercraft. For example, the turning velocity of the watercraft increases with an increase in the magnitude of the thrust of the watercraft even when the speed of changing the rudder angle of the marine propulsion device is constant. Conversely, the turning velocity of the watercraft reduces with a reduction in the magnitude of the thrust of the watercraft even when the speed of changing the rudder angle of the marine propulsion device is constant. When the turning velocity of the watercraft is greatly variable depending on the magnitude of the thrust, the comfort could be deteriorated in operating the watercraft.

SUMMARY OF THE INVENTION

Preferred embodiments of the present invention enhance the comfort in operating a watercraft by a joystick. A system according to a preferred embodiment of the present invention controls a watercraft and includes a marine propulsion device, a joystick, and a controller. The marine propulsion device is rotatable about a steering shaft. The joystick is operable by tilting and twisting. The joystick outputs an operating signal indicating a tilt amount thereof and a twist direction thereof. The controller receives the operating signal. The controller is configured or programmed to control the marine propulsion device to output a thrust having a magnitude depending on the tilt amount. The controller changes a rudder angle of the marine propulsion device such that the watercraft turns in a direction corresponding to the twist direction. The controller reduces a speed of changing the rudder angle with an increase in the magnitude of the thrust.

A method according to a preferred embodiment of the present invention controls a watercraft including a marine propulsion device rotatable about a steering shaft and includes receiving from a joystick operable by tilting and twisting an operating signal indicating a tilt amount of the joystick and a twist direction of the joystick; controlling the marine propulsion device to output a thrust having a magnitude depending on the tilt amount; changing a rudder angle of the marine propulsion device such that the watercraft turns in a direction corresponding to the twist direction; and reducing a speed of changing the rudder angle with an increase in the magnitude of the thrust.

A system according to a preferred embodiment of the present invention controls a watercraft and includes a marine propulsion device, a joystick, a selector, and a controller. The marine propulsion device is rotatable about a steering shaft. The joystick is operable by tilting and twisting. The joystick outputs an operating signal indicating a tilt amount thereof and a twist direction thereof. The selector is operable to select one of a plurality of levels as a thrust level. The selector outputs a setting signal indicating the thrust level. The controller receives the operating signal and the setting signal. The controller is configured or programmed to control the marine propulsion device to output a thrust having a magnitude depending on the tilt amount, while the magnitude of the thrust falls within a range up to a maximum thrust depending on the thrust level. The controller increases the maximum thrust with an increase in the magnitude of the thrust level. The controller changes a rudder angle of the marine propulsion device such that the watercraft turns in a direction corresponding to the twist direction. The controller reduces a speed of changing the rudder angle with the increase in the magnitude of the thrust level.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
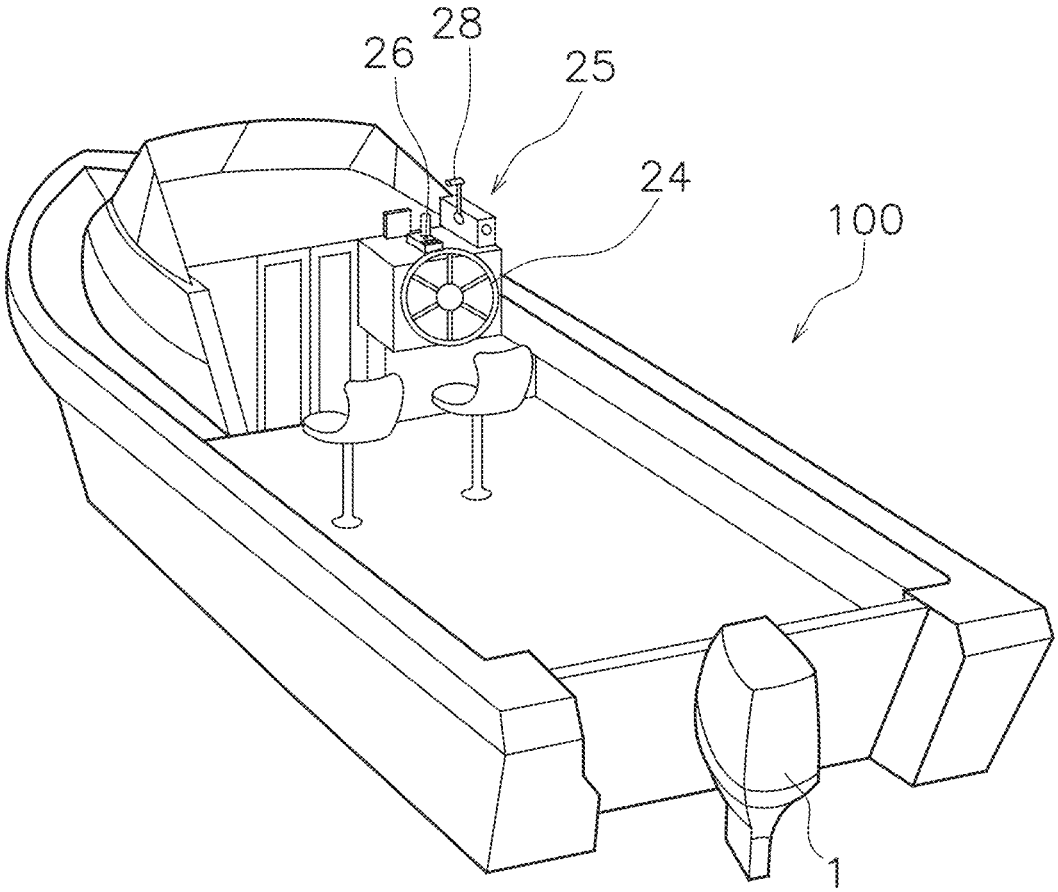
FIG. 1 is a perspective view of a watercraft to which a marine propulsion device according to a preferred embodiment of the present invention is mounted.

Preferred embodiments of the present invention will be hereinafter explained with reference to drawings. FIG. 1 is a perspective view of a watercraft 100 to which a marine propulsion device 1 according to a preferred embodiment of the present invention is mounted. The marine propulsion device 1 is mounted to the watercraft 100 as a single marine propulsion device, i.e., as the only marine propulsion device 1 mounted to the watercraft 100. In the present preferred embodiment, the marine propulsion device 1 is an outboard motor. The marine propulsion device 1 is attached to the stern of the watercraft 100. The marine propulsion device 1 generates a thrust to propel the watercraft 100.

Figure 2:
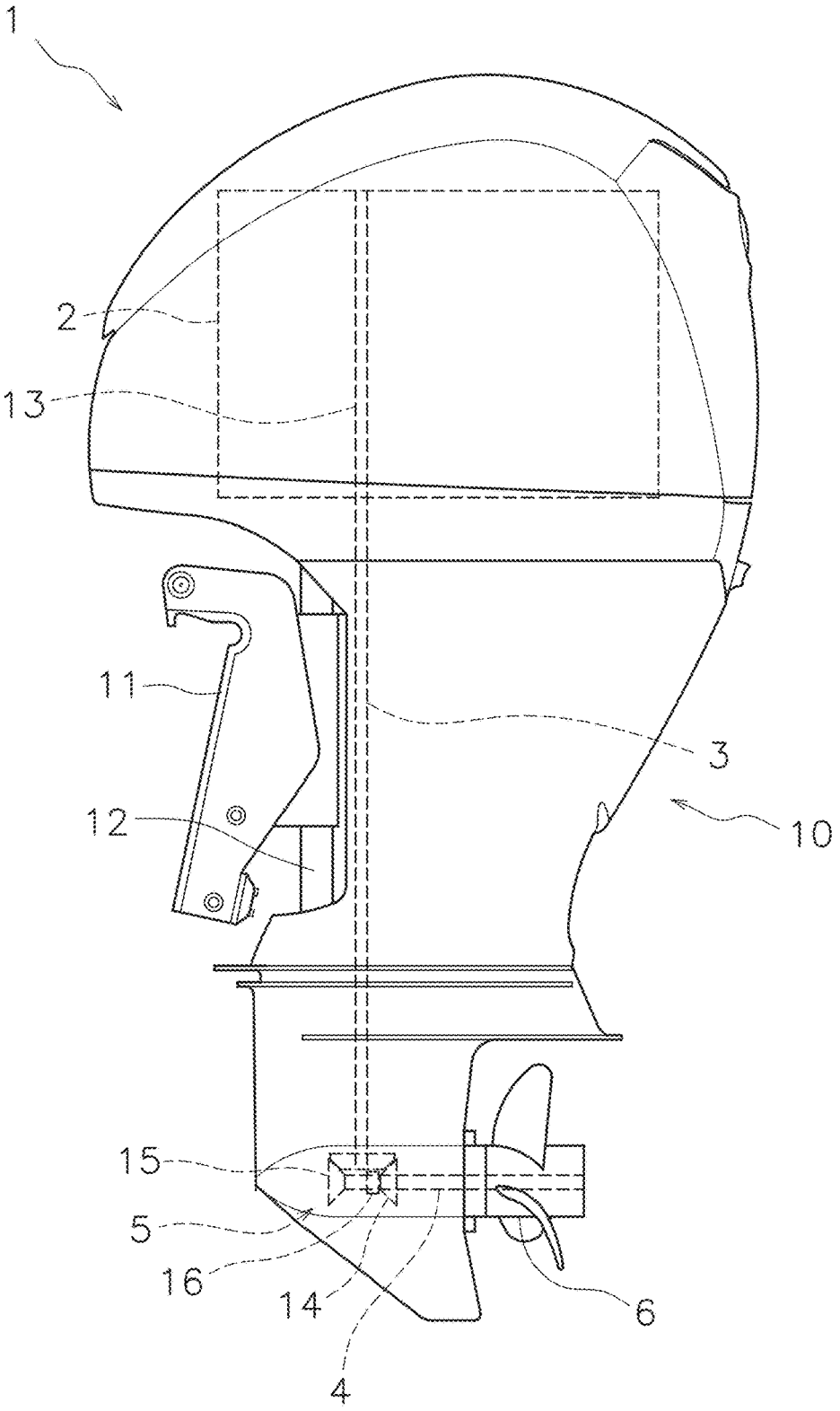
FIG. 2 is a side view of the marine propulsion device.

FIG. 2 is a side view of the marine propulsion device 1. The marine propulsion device 1 is attached to the watercraft 100 through a bracket 11. The bracket 11 supports the marine propulsion device 1 such that the marine propulsion device 1 is rotatable about a steering shaft 12. The steering shaft 12 extends in an up-and-down direction of the marine propulsion device 1.

The marine propulsion device 1 includes a drive unit 2, a drive shaft 3, a propeller shaft 4, a shift mechanism 5, and a housing 10. The drive unit 2 generates the thrust to propel the watercraft 100. The drive unit 2 is an internal combustion engine, for example. The drive unit 2 includes a crankshaft 13. The crankshaft 13 extends in the up-and-down direction of the marine propulsion device 1. The drive shaft 3 is connected to the crankshaft 13. The drive shaft 3 extends in the up-and-down direction of the marine propulsion device 1. The propeller shaft 4 extends in a back-and-forth direction of the marine propulsion device 1. The propeller shaft 4 is connected to the drive shaft 3 through the shift mechanism 5. A propeller 6 is attached to the propeller shaft 4.

The shift mechanism 5 includes a forward moving gear 14, a rearward moving gear 15, and a dog clutch 16. When gear engagement of each gear 14, 15 is switched by the dog clutch 16, the shift mechanism 5 is switched among a forward moving state, a rearward moving state, and a neutral state. When set in the forward moving state, the shift mechanism 5 transmits rotation, directed to move the watercraft 100 forward, from the drive shaft 3 to the propeller shaft 4. When set in the rearward moving state, the shift mechanism 5 transmits rotation, directed to move the watercraft 100 rearward, from the drive shaft 3 to the propeller shaft 4. When set in the neutral state, the shift mechanism 5 does not transmit rotation from the drive shaft 3 to the propeller shaft 4. The housing 10 accommodates the drive unit 2, the drive shaft 3, the propeller shaft 4, and the shift mechanism 5.

Figure 3:
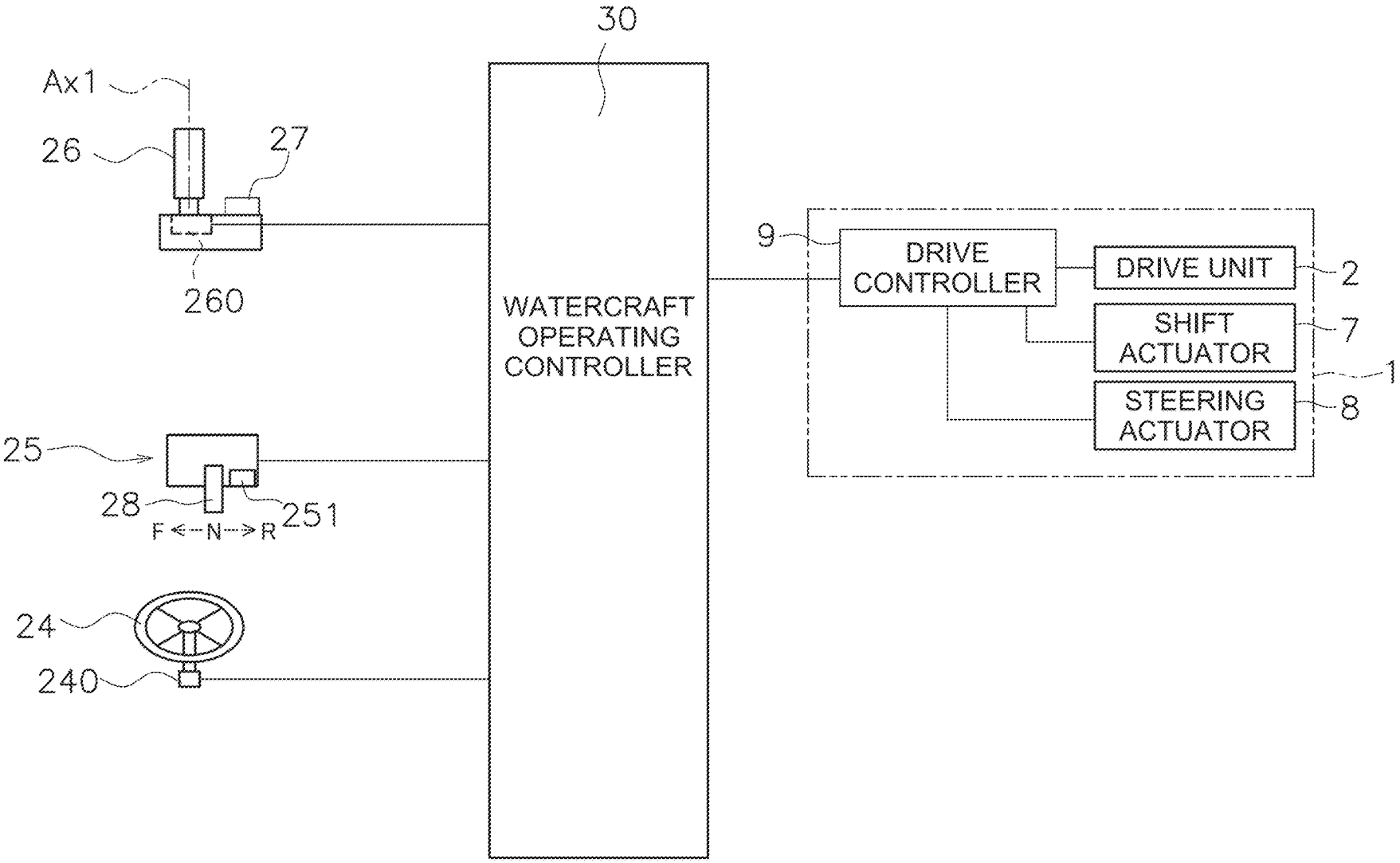
FIG. 3 is a schematic diagram showing a configuration of a watercraft operating system for the watercraft.

FIG. 3 is a schematic diagram showing a configuration of a watercraft operating system for the watercraft 100. As shown in FIG. 3, the marine propulsion device 1 includes a shift actuator 7 and a steering actuator 8.

The shift actuator 7 is connected to the dog clutch 16 of the shift mechanism 5. The shift actuator 7 actuates the dog clutch 16 to switch gear engagement of each gear 14, 15. In response, the shift mechanism 5 is switched among the forward moving state, the rearward moving state, and the neutral state. The shift actuator 7 includes, for instance, an electric motor. However, the shift actuator 7 may be another type of actuator such as an electric cylinder, a hydraulic motor, or a hydraulic cylinder.

The steering actuator 8 is connected to the marine propulsion device 1. The steering actuator 8 rotates the marine propulsion device 1 about the steering shaft 12. Accordingly, a rudder angle of the marine propulsion device 1 is changed. The rudder angle refers to an angle of the propeller shaft 4 with respect to the back-and-forth direction of the marine propulsion device 1. The steering actuator 8 includes, for instance, an electric motor. However, the steering actuator 8 may be another type of actuator such as an electric cylinder, a hydraulic motor, or a hydraulic cylinder.

The marine propulsion device 1 includes a drive controller 9. The drive controller 9 includes a processor such as a CPU (Central Processing Unit) and memories such as a RAM (Random Access Memory) and a ROM (Read Only Memory). The drive controller 9 stores a program and data to control the marine propulsion device 1. The drive controller 9 is configured or programmed to control the drive unit 2.

The watercraft operating system includes a steering wheel 24, a remote controller 25, a joystick 26, and a selector 27. The steering wheel 24, the remote controller 25, the joystick 26, and the selector 27 are located in a cockpit of the watercraft 100. The steering wheel 24, the remote controller 25, the joystick 26, and the selector 27 are manually operable.

The steering wheel 24 enables an operator to control a turning direction of the watercraft 100. The steering wheel 24 includes a sensor 240. The sensor 240 outputs a steering signal indicating an operating direction and an operating amount of the steering wheel 24.

The remote controller 25 includes a throttle lever 28. The throttle lever 28 enables the operator to regulate the magnitude of the thrust generated by the marine propulsion device 1. The throttle lever 28 also enables the operator to switch the direction of the thrust generated by the marine propulsion device 1 between forward and rearward directions. The throttle lever 28 is operable from a neutral position to a forward moving position and a rearward moving position. The neutral position is located between the forward moving position and the rearward moving position. The throttle lever 28 includes a sensor 251. The sensor 251 outputs a throttle signal indicating an operating direction and an operating amount of the throttle lever 28.

The joystick 26 is tiltable at least back and forth from a neutral position in two directions. The joystick 26 may be tiltable in more than two directions, and preferably all directions. The joystick 26 is rotatable (twistable) about a rotational axis Ax1. In other words, the joystick 26 is operable to be twisted clockwise and counterclockwise about the rotational axis Ax1 from the neutral position. The joystick 26 includes a sensor 260. The sensor 260 outputs an operating signal that indicates the operation of the joystick 26. The operating signal contains information regarding a tilt direction and a tilt amount of the joystick 26. The operating signal also contains information regarding a twist direction and a twist amount of the joystick 26.

Figure 4:
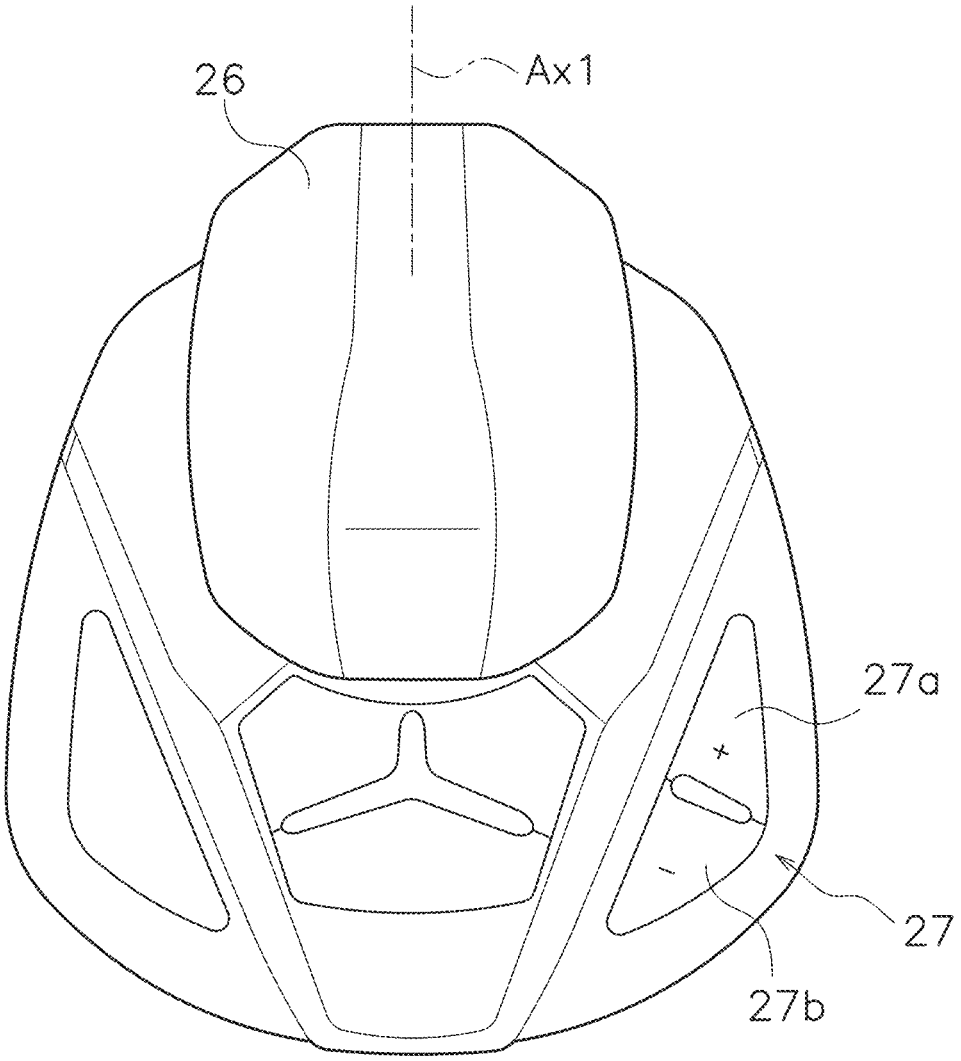
FIG. 4 is a front view of a joystick.

The selector 27 is operable to select one of a plurality of levels as a thrust level in operating the watercraft 100 by the joystick 26. An upper limit of the thrust outputted from the marine propulsion device 1 (hereinafter referred to as "maximum thrust") increases with an increase in the magnitude of the thrust level. The selector 27 is provided on the joystick 26, for example. FIG. 4 is a diagram showing the joystick 26. As shown in FIG. 4, the selector 27 includes a plus switch 27*a* and a minus switch 27*b*. When the plus switch 27*a* is pressed once, the thrust level is increased by one. When the minus switch 27*b* is pressed once, the thrust level is decreased by one. The selector 27 outputs a setting signal indicating the thrust level.

The watercraft operating system includes a watercraft operating controller 30. The watercraft operating controller 30 includes a processor such as a CPU and memories such as a RAM and a ROM. The watercraft operating controller 30 stores a program and data to control the marine propulsion device 1. The watercraft operating controller 30 is connected to the drive controller 9 through wired or wireless communication. The watercraft operating controller 30 is connected to the steering wheel 24, the remote controller 25, the joystick 26, and the selector 27 through wired or wireless communication.

The watercraft operating controller 30 receives the steering signal from the sensor 240. The watercraft operating controller 30 receives the throttle signal from the sensor 251. The watercraft operating controller 30 outputs command signals to the drive controller 9 based on the signals received from the sensors 240 and 251. The command signals are transmitted to the drive unit 2, the shift actuator 7, and the steering actuator 8 through the drive controller 9. For example, the watercraft operating controller 30 outputs a command signal for the shift actuator 7 in accordance with the operating direction of the throttle lever 28. In response, shifting between forward movement and rearward movement by the marine propulsion device 1 is performed. The watercraft operating controller 30 outputs a throttle command for the drive unit 2 in accordance with the operating amount of the throttle lever 28. The drive controller 9 controls an output rotational speed of the marine propulsion device 1 in accordance with the throttle command.

The watercraft operating controller 30 outputs a command signal for the steering actuator 8 in accordance with the operating direction and the operating amount of the steering wheel 24. When the steering wheel 24 is operated leftward from the neutral position, the watercraft operating controller 30 controls the steering actuator 8 such that the marine propulsion device 1 is rotated clockwise. The watercraft 100 thus turns leftward. When the steering wheel 24 is operated rightward from the neutral position, the watercraft operating controller 30 controls the steering actuator 8 such that the marine propulsion device 1 is rotated counterclockwise. The watercraft 100 thus turns rightward. Additionally, the watercraft operating controller 30 controls the rudder angle of the marine propulsion device 1 depending on the operating amount of the steering wheel 24.

The watercraft operating controller 30 receives the operating signal from the sensor 260. The watercraft operating controller 30 receives the setting signal from the selector 27. The watercraft operating controller 30 outputs a command signal to the drive controller 9 based on the operating signal and the setting signal. The command signal is transmitted to the drive unit 2, the shift actuator 7, and the steering actuator 8 through the drive controller 9.

The watercraft operating controller 30 controls the marine propulsion device 1 to output a thrust, having a magnitude depending on the tilt amount of the joystick 26, in a direction corresponding to the tilt direction of the joystick 26. The watercraft operating controller 30 sets the thrust level in accordance with the setting signal received from the selector 27. When the joystick 26 is tilted forward, the watercraft operating controller 30 causes the marine propulsion device 1 to generate a thrust oriented in the forward moving direction such that the thrust has a magnitude depending on the tilt amount of the joystick 26 and the magnitude of the thrust that falls within a range up to the maximum thrust depending on the thrust level. The watercraft 100 thus moves forward. When the joystick 26 is tilted rearward, the watercraft operating controller 30 causes the marine propulsion device 1 to generate a thrust oriented in the rearward moving direction such that the thrust has a magnitude depending on the tilt amount of the joystick 26 and the magnitude of the thrust falls within the range up to the maximum thrust depending on the thrust level. The watercraft 100 thus moves rearward.

Figure 5A:
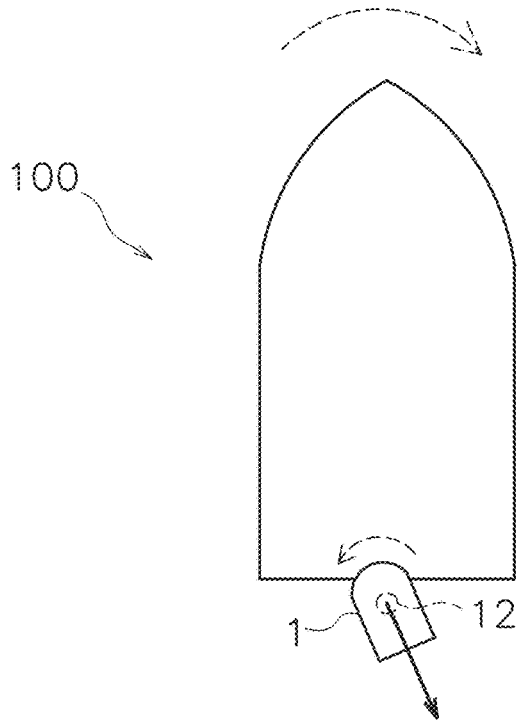
FIG. 5A is a diagram showing a rudder angle of the marine propulsion device when the joystick is twisted clockwise.
Figure 5B:
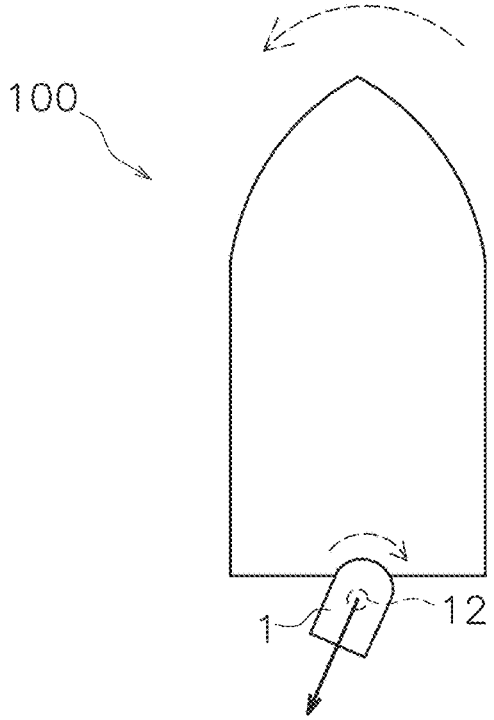
FIG. 5B is a diagram showing the rudder angle of the marine propulsion device when the joystick is twisted counterclockwise.

The watercraft operating controller 30 changes the rudder angle of the marine propulsion device 1 such that the watercraft 100 turns in a direction corresponding to the twist direction of the joystick 26. The watercraft operating controller 30 changes the rudder angle of the marine propulsion device 1 such that the rudder angle becomes a target angle depending on the twist amount of the joystick 26. As shown in FIG. 5A, when the joystick 26 is twisted clockwise, the watercraft operating controller 30 controls the steering actuator 8 such that the marine propulsion device 1 is rotated counterclockwise. The watercraft 100 thus turns rightward. As shown in FIG. 5B, when the joystick 26 is twisted counterclockwise, the watercraft operating controller 30 controls the steering actuator 8 such that the marine propulsion device 1 is rotated clockwise. The watercraft 100 thus turns leftward.

When the joystick 26 is tilted and twisted, the watercraft operating controller 30 causes the marine propulsion device 1 to generate a thrust having a magnitude depending on the tilt amount of the joystick 26 and changes the rudder angle of the marine propulsion device 1 such that the watercraft 100 turns in a direction corresponding to the twist direction of the joystick 26. At this time, the watercraft operating controller 30 reduces the steering speed with an increase in the magnitude of the thrust. The steering speed refers to a speed of changing the rudder angle. The watercraft operating controller 30 stores a default value to be set for the steering speed when the joystick 26 is twisted. The watercraft operating controller 30 sets an upper limit to the steering speed. The watercraft operating controller 30 reduces the upper limit with the increase in the magnitude of the thrust such that the steering speed is reduced.

Figure 6:
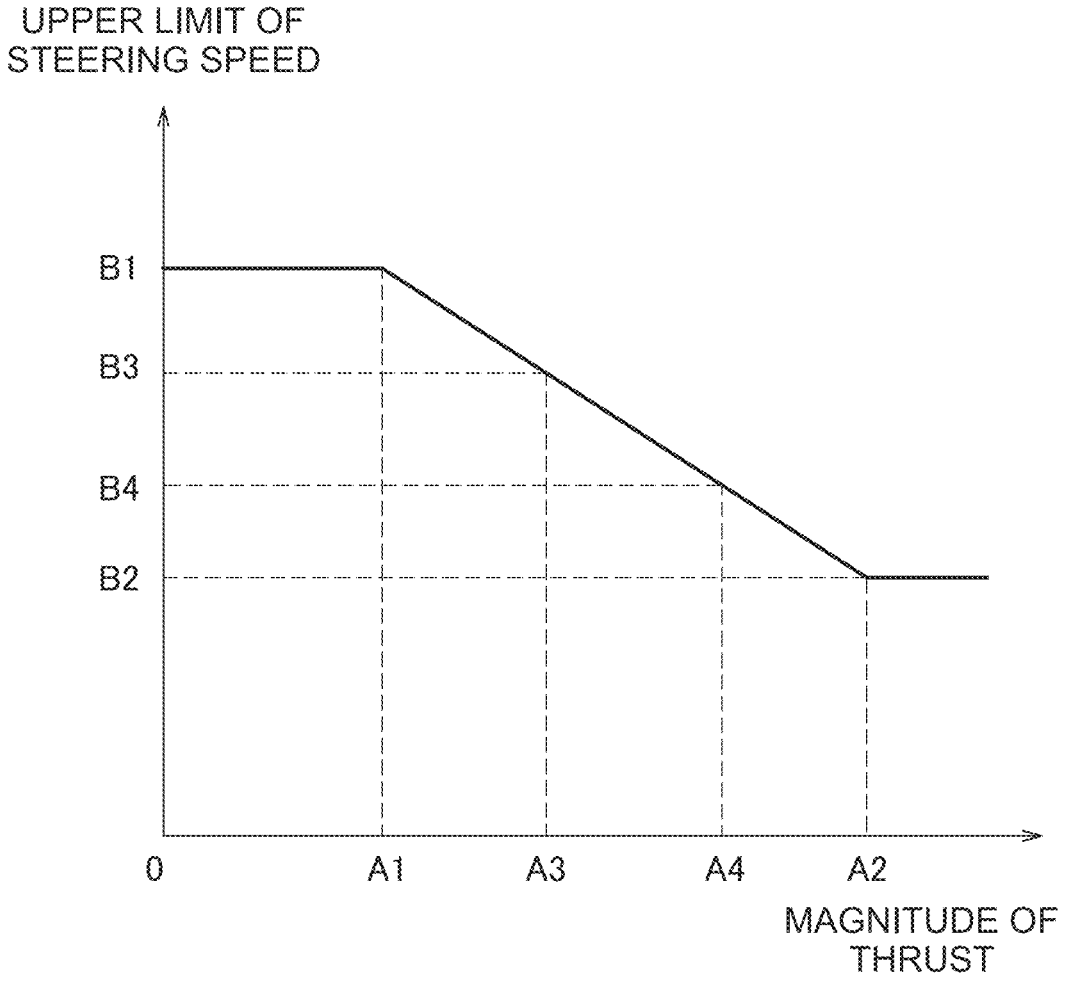
FIG. 6 is a chart showing an example of steering speed data.

The watercraft operating controller 30 stores steering speed data as shown in FIG. 6. The steering speed data defines the upper limit of the steering speed with respect to the magnitude of the thrust. The watercraft operating controller 30 determines the magnitude of the thrust based on the thrust level and the tilt amount of the joystick 26. With reference to the steering speed data, the watercraft operating controller 30 determines the upper limit of the steering speed with respect to the magnitude of the thrust. As shown in FIG. 6, in the steering speed data, the upper limit is made constant at B1 when the magnitude of the thrust falls within a range of 0 to A1. The upper limit reduces with the increase in the magnitude of the thrust when the magnitude of the thrust falls within a range of A1 to A2. The upper limit is made constant at B2, which is less than B1, when the magnitude of the thrust falls within a range of A2 and greater.

Figure 7:
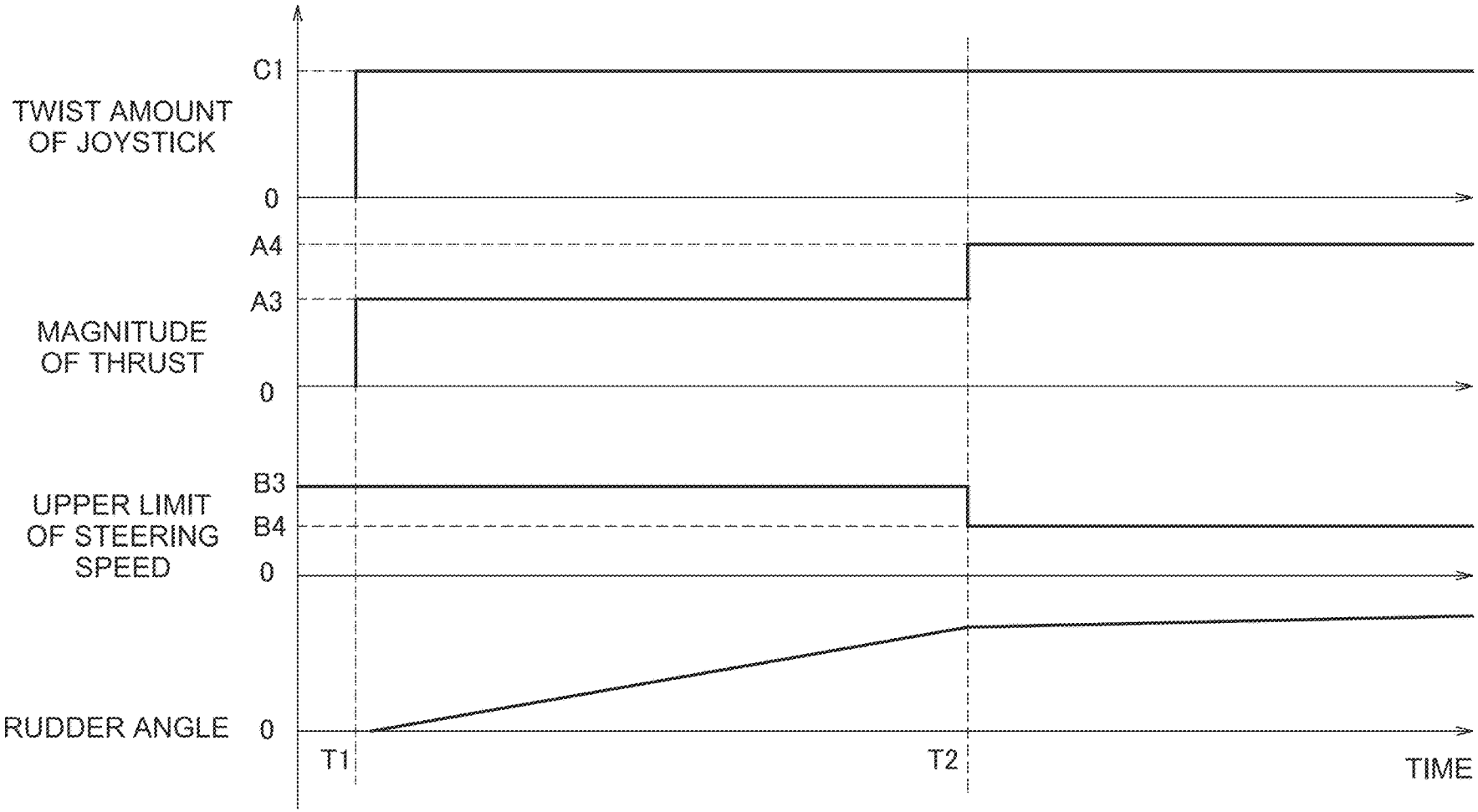
FIG. 7 is a timing chart showing controls executed by the marine propulsion device when the joystick is tilted and twisted.

FIG. 7 is a timing chart showing changes in the following items in tilting and twisting the joystick 26: the twist amount of the joystick 26, the magnitude of the thrust, the upper limit of the steering speed, and the rudder angle. The joystick 26 is tilted and twisted at time T1. At time T1, the joystick 26 is twisted by a twist amount C1, while the magnitude of the thrust is A3. With reference to the steering speed data shown in FIG. 6, the watercraft operating controller 30 determines B3 as the upper limit of the steering speed corresponding to the magnitude-of-thrust A3. The watercraft operating controller 30 changes the rudder angle of the marine propulsion device 1 such that the rudder angle is changed at a steering speed of the upper limit B3 or less so as to become a target angle. The rudder angle of the marine propulsion device 1 is thereby gradually increased from time T1 as shown in FIG. 7.

At time T2, the joystick 26 is further tilted by a large amount such that the magnitude of the thrust increases from A3 to A4. The twist amount of the joystick 26 is made constant at C1. With reference to the steering speed data, the watercraft operating controller 30 determines B4 as the upper limit of the steering speed corresponding to the magnitude-of-thrust A4. The watercraft operating controller 30 changes the rudder angle of the marine propulsion device 1 such that the rudder angle is changed at a steering speed of the upper limit B4 or less so as to become a target angle. The upper limit B4 is less than the upper limit B3 as shown in FIG. 6. Therefore, the rudder angle of the marine propulsion device 1 is more slowly increased at time T2 and thereafter than before time T2 as shown in FIG. 7.

Figure 8A:
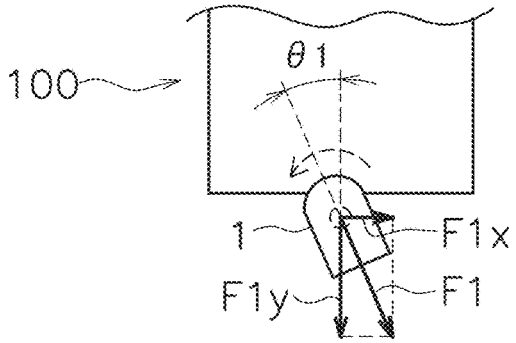
FIG. 8A is a diagram showing the rudder angle of the marine propulsion device and thrust components when a thrust F1 is generated in the watercraft operating system according to a preferred embodiment of the present invention.
Figure 8B:
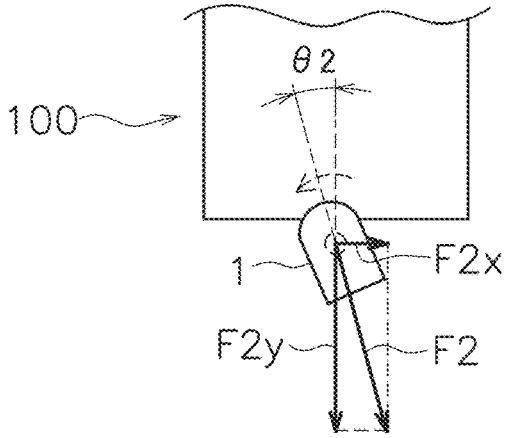
FIG. 8B is a diagram showing the rudder angle of the marine propulsion device and thrust components when a thrust F2 is generated in the watercraft operating system according to a preferred embodiment of the present invention.
Figure 8C:
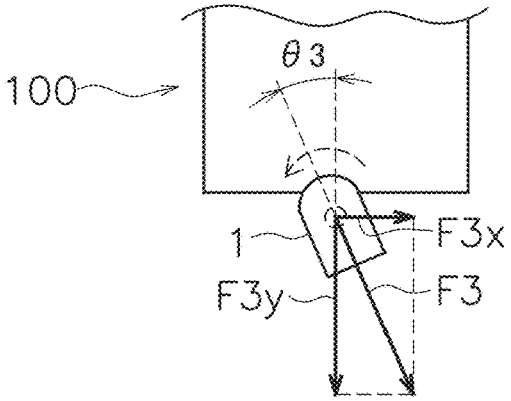
FIG. 8C is a diagram showing the rudder angle of the marine propulsion device and thrust components when a thrust F3 is generated in a watercraft operating system according to a comparative example.

FIG. 8A is a diagram showing the rudder angle of the marine propulsion device 1 and thrust components when a thrust F1 is generated in the watercraft operating system according to a preferred embodiment of the present invention. FIG. 8B is a diagram showing the rudder angle of the marine propulsion device 1 and thrust components when a thrust F2 is generated in the watercraft operating system according to a preferred embodiment of the present invention. The thrust F2 is greater in magnitude than the thrust F1. FIG. 8C is a diagram showing the rudder angle of the marine propulsion device 1 and thrust components when a thrust F3 is generated in a watercraft operating system according to a comparative example. The thrust F3 is equal in magnitude to the thrust F2. However, in the watercraft operating system according to the comparative example, the steering speed is constant regardless of the magnitude of the thrust. It is assumed that a predetermined length of time has commonly elapsed among FIGS. 8A, 8B, and 8C since starting a change in the rudder angle.

As shown in FIG. 8A, the rudder angle of the marine propulsion device 1 is θ1 when the thrust F1 is being generated. A thrust F1*y* is being generated in a longitudinal direction of the watercraft 100 as a longitudinal component of the thrust F1. A thrust F1*x* is being generated in a right-and-left direction of the watercraft 100 as a right-and-left component of the thrust F1.

As shown in FIG. 8B, the rudder angle of the marine propulsion device 1 is θ2 when the thrust F2 is being generated. In the watercraft operating system according to the present preferred embodiment, the steering speed is reduced with the increase in the magnitude of the thrust. Because of this, the angle θ2 is less than the angle θ1. A thrust F2*y* is being generated in the longitudinal direction of the watercraft 100 as a longitudinal component of the thrust F2. A thrust F2*x* is being generated in the right-and-left direction of the watercraft 100 as a right-and-left component of the thrust F2. The thrust F2 shown in FIG. 8B is greater in magnitude than the thrust F1 shown in FIG. 8A. However, the rudder angle θ2 shown in FIG. 8B is less than the rudder angle θ1 shown in FIG. 8A. Because of this, the thrust F2*x*, generated in the right-and-left direction of the watercraft 100 shown in FIG. 8B, is equivalent in magnitude to the thrust F1*x* generated in the right-and-left direction of the watercraft 100 shown in FIG. 8A.

Figure 9:
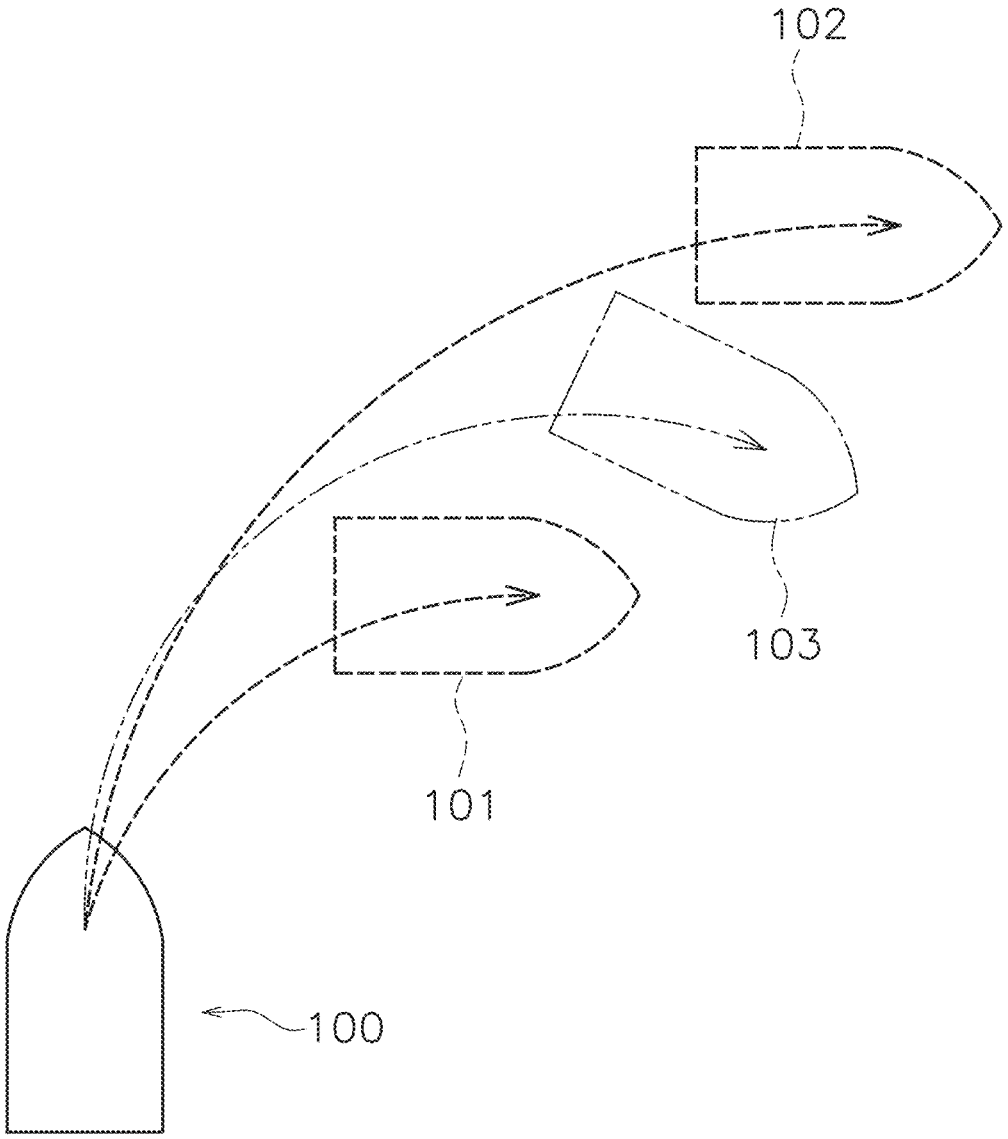
FIG. 9 is a schematic diagram showing motions performed by the watercraft when the joystick is tilted and twisted.

FIG. 9 is a schematic diagram showing motions performed by the watercraft 100 when the joystick 26 is tilted and twisted. In FIG. 9, a position 101 shows a motion of the watercraft 100 turning in the condition shown in FIG. 8A. A position 102 shows a motion of the watercraft 100 turning in the condition shown in FIG. 8B. A position 103 shows a motion of the watercraft 100 turning in the condition shown in FIG. 8C. A moving distance of the watercraft 100 is greater in the condition indicated by the position 102, in which the magnitude of the thrust is large, than in the condition indicated by the position 101, in which the magnitude of the thrust is small. However, the thrusts F2*x* and F1*x*, both generated in the right-and-left direction of the watercraft 100, are equivalent in magnitude to each other, such that the turning velocity of the watercraft 100 is equal or approximately equal between when the magnitude of the thrust is large and when the magnitude of the thrust is small. Because of this, in the assumption that the predetermined length of time has commonly elapsed among turning motions as shown in FIG. 9, a turning angle of the watercraft 100 is equal or approximately equal between when the magnitude of the thrust is large and when the magnitude of the thrust is small.

As shown in FIG. 8C, in the watercraft operating system according to the comparative example, the rudder angle of the marine propulsion device 1 is θ3 when the thrust F3, equal in magnitude to the thrust F2, is being generated. However, in the watercraft operating system according to the comparative example, the steering speed is not reduced depending on the magnitude of the thrust. Therefore, even when the thrust F3 is being generated, the angle θ3 is equal to the angle θ1 shown in FIG. 8A. Because of this, in FIG. 8C, a thrust F3*x*, generated in the right-and-left direction of the watercraft 100, is greater in magnitude than the thrust Fix generated in the right-and-left direction of the watercraft 100 shown in FIG. 8A and the thrust F2*x* generated in the right-and-left direction of the watercraft 100 shown in FIG. 8B. In this case, the turning velocity is greater in FIG. 8C than in FIG. 8A. Because of this, as shown in FIG. 9, the turning angle of the watercraft 100 is greater in the condition indicated by the position 103 than in the condition indicated by the position 101, in which the magnitude of the thrust is small.

Figure 10:
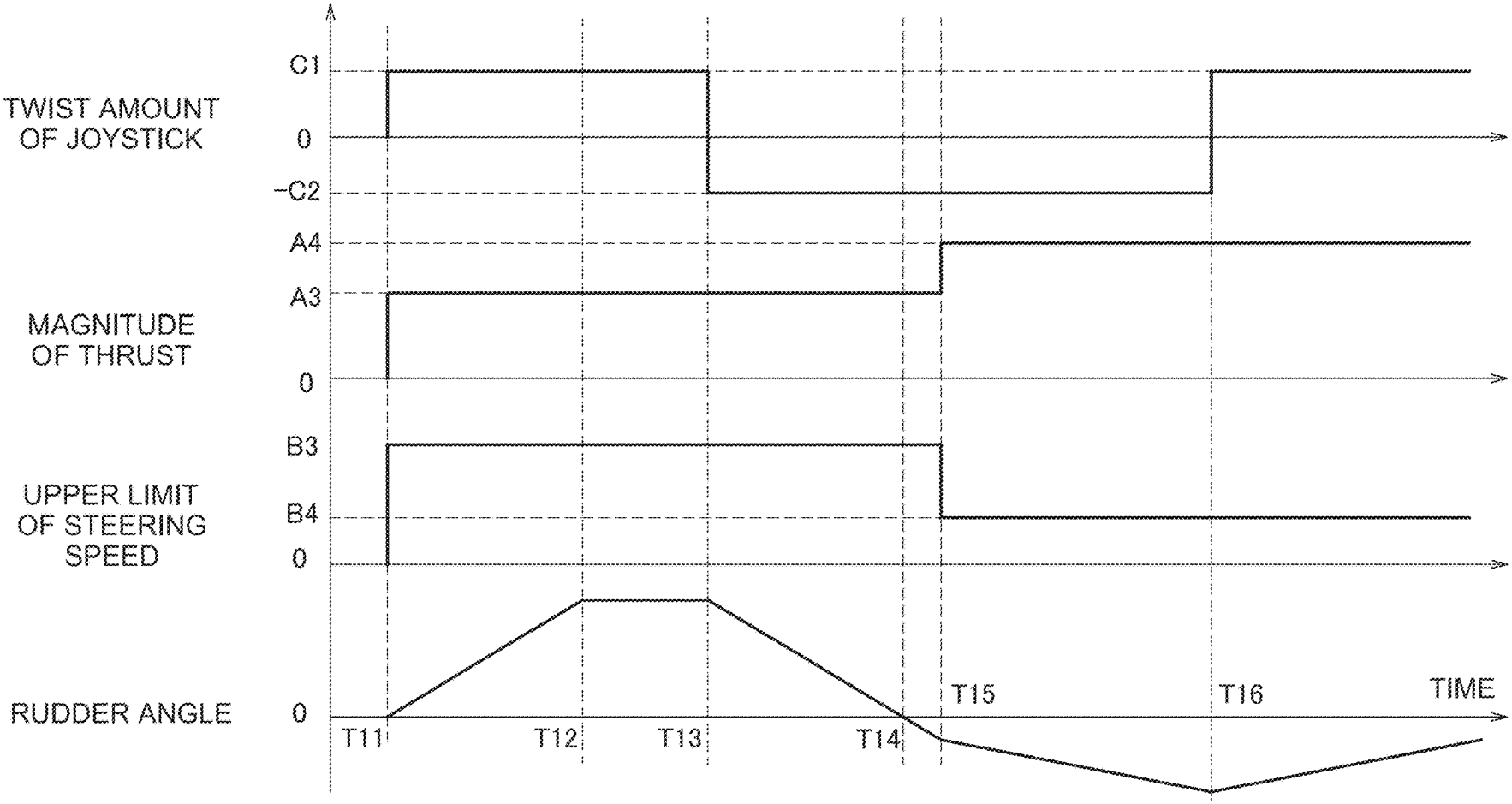
FIG. 10 exemplifies another timing chart showing controls executed by the marine propulsion device when the joystick is tilted and twisted.

FIG. 10 exemplifies another timing chart showing changes in the following items in tilting and twisting the joystick 26: the twist amount of the joystick 26, the magnitude of the thrust, the upper limit of the steering speed, and the rudder angle. The joystick 26 is tilted and twisted clockwise at time T11. At time T11, the joystick 26 is twisted clockwise by a twist amount C1, while the magnitude of the thrust is A3. With reference to the steering speed data shown in FIG. 6, the watercraft operating controller 30 determines B3 as the upper limit of the steering speed corresponding to the magnitude-of-thrust A3. The watercraft operating controller 30 changes the rudder angle of the marine propulsion device 1 by turning the marine propulsion device 1 counterclockwise such that the rudder angle is changed at a steering speed of the upper limit B3 or less so as to become a target angle. The rudder angle of the marine propulsion device 1 is thereby gradually increased to the counterclockwise side from time T11 as shown in FIG. 10. The rudder angle of the marine propulsion device 1 reaches the target angle at time T12 and is made constant at the target angle until time T13.

At time T13, the joystick 26 is twisted counterclockwise by a twist amount C2, while the tilt amount is maintained. In response to this, the watercraft operating controller 30 rotates the marine propulsion device 1 clockwise, while the magnitude of the thrust and the upper limit of the steering speed are kept as it is. The rudder angle of the marine propulsion device 1 is thereby gradually reduced from time T13 and is then gradually increased to the clockwise side at time T14 and thereafter as shown in FIG. 10.

At time T15, the joystick 26 is further tilted by a large amount, such that the magnitude of the thrust increases from A3 to A4. The twist amount of the joystick 26 is made constant at C2. With reference to the steering speed data, the watercraft operating controller 30 determines B4 as the upper limit of the steering speed corresponding to the magnitude-of-thrust A4. The watercraft operating controller 30 changes the rudder angle of the marine propulsion device 1 such that the rudder angle is changed at a steering speed of the upper limit B4 or less so as to become a target angle. The upper limit B4 is less than the upper limit B3. Therefore, as shown in FIG. 10, the rudder angle of the marine propulsion device 1 is increased to the clockwise side at time T15 and thereafter more gently than before time T15.

At time T16, the joystick 26 is twisted clockwise by the twist amount C1, while the tilt amount is kept as it is. In response to this, the watercraft operating controller 30 rotates the marine propulsion device 1 counterclockwise, while the magnitude of the thrust and the upper limit of the steering speed are kept as it is. Accordingly, as shown in FIG. 10, the rudder angle of the marine propulsion device 1 is gradually reduced from time T16.

In the watercraft operating systems according to preferred embodiments of the present invention explained above, the steering speed reduces with an increase in the magnitude of the thrust. Because of this, the difference in turning velocity of the watercraft 100 among different magnitudes of the thrust is made small, such that the difference in the turning angle of the watercraft 100 among different magnitudes of the thrust is made small as well. Consequently, the comfort is enhanced when operating the watercraft 100 by the joystick 26.

Preferred embodiments of the present invention have been explained above. However, the present invention is not limited to the preferred embodiments described above, and a variety of changes can be made without departing from the gist of the present invention.

The marine propulsion device 1 is not limited to the outboard motor, and alternatively, may be another type of propulsion device such as an inboard engine outboard drive or a jet propulsion device. The structure of the marine propulsion device 1 is not limited to that in the preferred embodiments described above and may be changed. For example, the drive unit 2 is not limited to the internal combustion engine, and alternatively, may be an electric motor. Yet alternatively, the drive unit 2 may be a hybrid system of an internal combustion engine and an electric motor. The number of marine propulsion devices is not limited to one. The number of marine propulsion devices may be two or greater. The selector 27 may be separate from the joystick 26. The selector 27 is not limited to the switch, and alternatively, may include another type of operating device such as a touchscreen.

In the preferred embodiments described above, the upper limit of the steering speed is reduced with an increase in the magnitude of the thrust, such that the steering speed is reduced. However, the watercraft operating controller 30 may directly reduce the steering speed with the increase in the magnitude of the thrust. In the preferred embodiments described above, the watercraft operating controller 30 reduces the steering speed with the increase in the magnitude of the thrust. However, the watercraft operating controller 30 may reduce the steering speed with the increase in the magnitude of the thrust level.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft, the system comprising:

a marine propulsion device rotatable about a steering shaft;

a joystick operable by tilting and twisting to output an operating signal indicating a tilt amount and a twist direction of the joystick; and a controller configured or programmed to:

receive the operating signal;

control the marine propulsion device to output a thrust having a magnitude depending on the tilt amount;

change a rudder angle of the marine propulsion device such that the watercraft turns in a direction corresponding to the twist direction; and reduce a speed of changing the rudder angle with an increase in the magnitude of the thrust.

2. The system according to claim 1, wherein the controller is configured or programmed to reduce the speed of changing the rudder angle such that a component of the thrust oriented in a right-and-left direction of the watercraft stays constant regardless of the increase in the magnitude of the thrust.

3. The system according to claim 1, wherein the controller is configured or programmed to reduce the speed of changing the rudder angle by reducing an upper limit of the speed of changing the rudder angle with the increase in the magnitude of the thrust.

4. The system according to claim 3, wherein the controller is configured or programmed to make the upper limit constant when the magnitude of the thrust is less than or equal to a predetermined threshold.

5. The system according to claim 1, wherein the marine propulsion device is the only marine propulsion device mounted to the watercraft.

6. A method of controlling a watercraft including a marine propulsion device rotatable about a steering shaft, the method comprising:

receiving an operating signal from a joystick operable by tilting and twisting, the operating signal indicating a tilt amount of the joystick and a twist direction of the joystick;

controlling the marine propulsion device to output a thrust having a magnitude depending on the tilt amount;

changing a rudder angle of the marine propulsion device such that the watercraft turns in a direction corresponding to the twist direction; and reducing a speed of changing the rudder angle with an increase in the magnitude of the thrust.

7. The method according to claim 6, wherein the speed of changing the rudder angle is reduced such that a component of the thrust oriented in a right-and-left direction of the watercraft stays constant regardless of the increase in the magnitude of the thrust.

8. The method according to claim 6, wherein the speed of changing the rudder angle is reduced by reducing an upper limit of the speed of changing the rudder angle with the increase in the magnitude of the thrust.

9. The method according to claim 8, further comprising:

making the upper limit constant when the magnitude of the thrust is less than or equal to a predetermined threshold.

10. The method according to claim 6, wherein the marine propulsion device is the only marine propulsion device mounted to the watercraft.

11. A system for controlling a watercraft, the system comprising:

a marine propulsion device rotatable about a steering shaft;

a joystick operable by tilting and twisting to output an operating signal indicating a tilt amount and a twist direction of the joystick;

a selector operable to select one of a plurality of levels as a thrust level and output a setting signal indicating the thrust level; and a controller configured or programmed to:

receive the operating signal and the setting signal;

control the marine propulsion device to output a thrust having a magnitude depending on the tilt amount that falls within a range up to a maximum thrust depending on the thrust level;

increase the maximum thrust with an increase in the magnitude of the thrust level;

change a rudder angle of the marine propulsion device such that the watercraft turns in a direction corresponding to the twist direction; and reduce a speed of changing the rudder angle with the increase in the magnitude of the thrust level.

12. The system according to claim 11, wherein the controller is configured or programmed to reduce the speed of changing the rudder angle such that a component of the thrust oriented in a right-and-left direction of the watercraft stays constant regardless of the increase in the magnitude of the thrust level.

13. The system according to claim 11, wherein the controller is configured or programmed to reduce the speed of changing the rudder angle by reducing an upper limit of the speed of changing the rudder angle with the increase in the magnitude of the thrust level.

* * * * *